US011524248B2

(12) United States Patent
Choi

(10) Patent No.: US 11,524,248 B2
(45) Date of Patent: Dec. 13, 2022

(54) FOLLOWING ROBOT

(71) Applicant: Dongguan Silverlit Toys Co., Ltd., Dongguan (CN)

(72) Inventor: Kei Fung Choi, Causeway Bay (HK)

(73) Assignee: Dongguan Silverlit Toys Co., Ltd., Dongguan (CN)

( * ) Notice: Subject to any disclaimer, the term of this patent is extended or adjusted under 35 U.S.C. 154(b) by 637 days.

(21) Appl. No.: 16/584,279

(22) Filed: Sep. 26, 2019

(65) Prior Publication Data

US 2020/0215447 A1 Jul. 9, 2020

(30) Foreign Application Priority Data

Jan. 3, 2019 (CN) ..... 201910010541.5

(51) Int. Cl.

*A63H 30/04* (2006.01)
*A63H 13/04* (2006.01)
*A63H 29/22* (2006.01)

(52) U.S. Cl.

CPC ..... *A63H 13/04* (2013.01); *A63H 29/22* (2013.01); *A63H 30/04* (2013.01); *A63H 2200/00* (2013.01)

(58) Field of Classification Search

CPC ..... A63H 11/00; A63H 11/18; A63H 11/20; A63H 30/04

See application file for complete search history.

(56) References Cited

U.S. PATENT DOCUMENTS 5,452,901 A * 9/1995 Nakada ..... A63H 30/04 446/454
6,110,000 A * 8/2000 Ting ..... A63H 30/04 446/175
6,309,275 B1 * 10/2001 Fong ..... A63H 30/04 446/175
6,380,844 B2 * 4/2002 Pelekis ..... H04B 10/1149 446/268
6,648,719 B2 * 11/2003 Chan ..... A63H 3/16 446/297
7,183,929 B1 * 2/2007 Antebi ..... A63H 30/04 340/384.1
9,830,778 B2 * 11/2017 Atsmon ..... G06K 19/0728
9,950,271 B2 * 4/2018 Sofman ..... A63H 30/04
2003/0220044 A1 * 11/2003 Andrews ..... A63H 13/10 446/268

FOREIGN PATENT DOCUMENTS

CN 105169716 A 12/2015
CN 105955261 A 9/2016
CN 106251576 A 12/2016
CN 206315465 U 7/2017
CN 206526512 U 9/2017
CN 206809761 U 12/2017
CN 207532782 U 6/2018

* cited by examiner

*Primary Examiner* — John A Ricci
(74) *Attorney, Agent, or Firm* — Greenberg Traurig, LLP

(57) ABSTRACT

A robot system has a follower robot and a leader robot. The follower robot follows the path of the leader robot using infrared (IR) signals. The follower robot follows the physical path and positioning of the leader robot. The leader robot is permitted to travel an arbitrary path or is controlled by a wireless transmitter. Relative robot positioning, being distance or direction can use an infrared system between respective robots.

15 Claims, 12 Drawing Sheets

Figure 1:
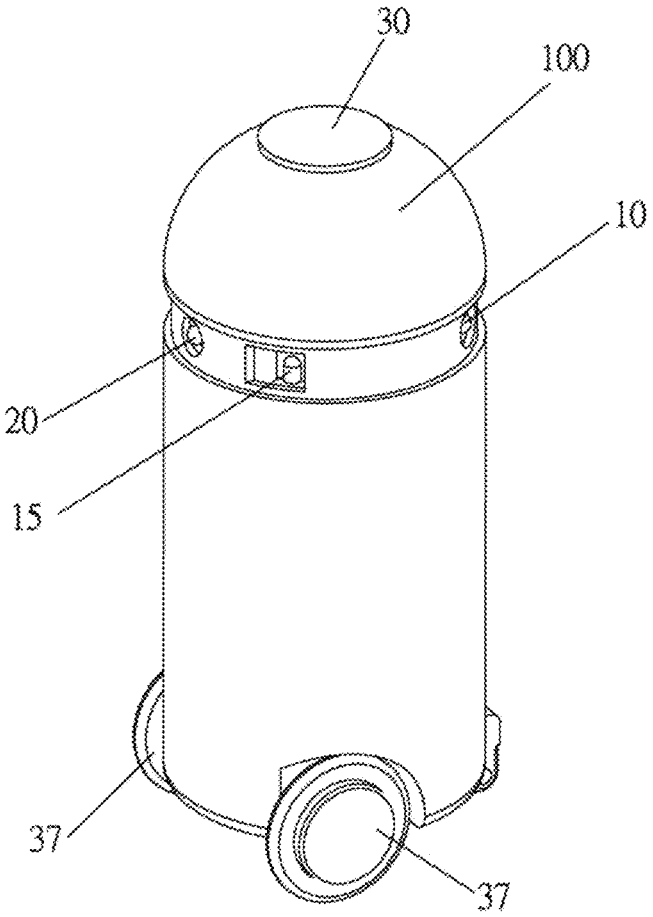

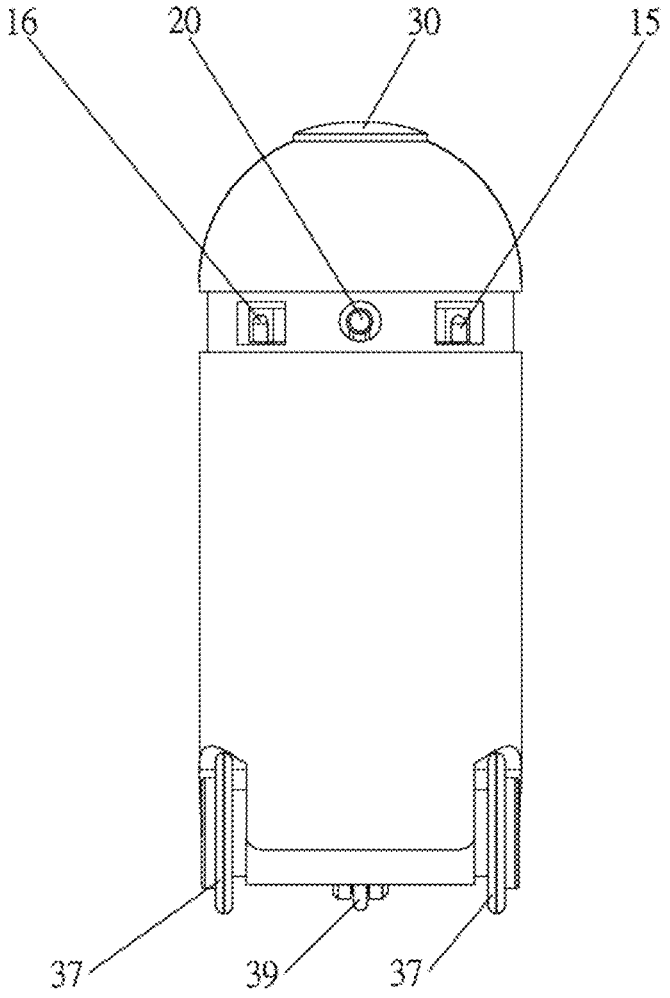
FIG.2-a

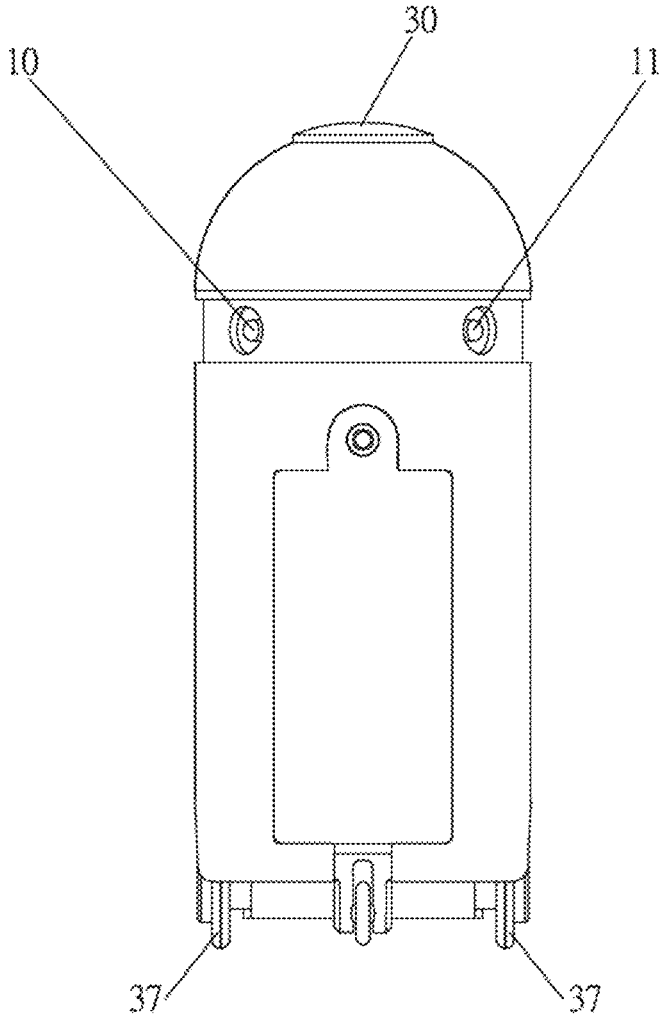
FIG.2-b

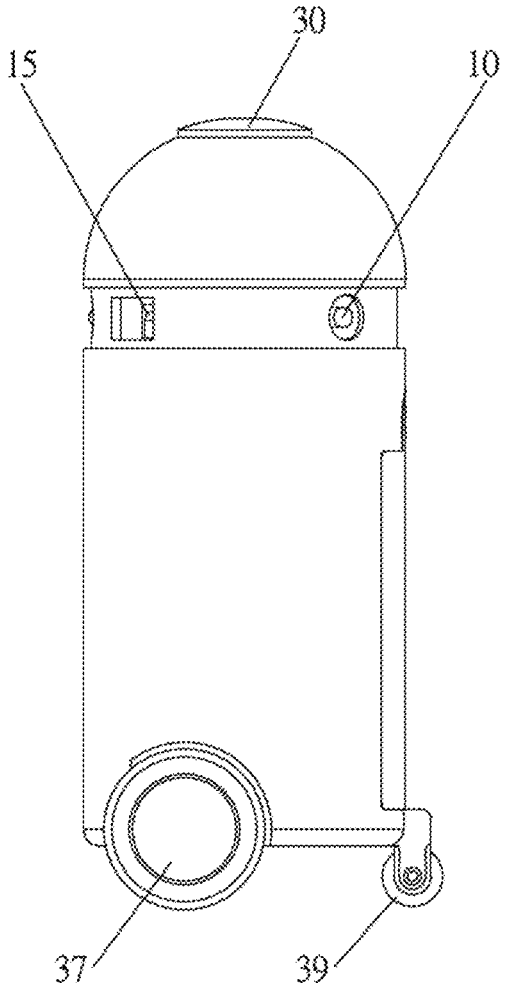
FIG.2-c

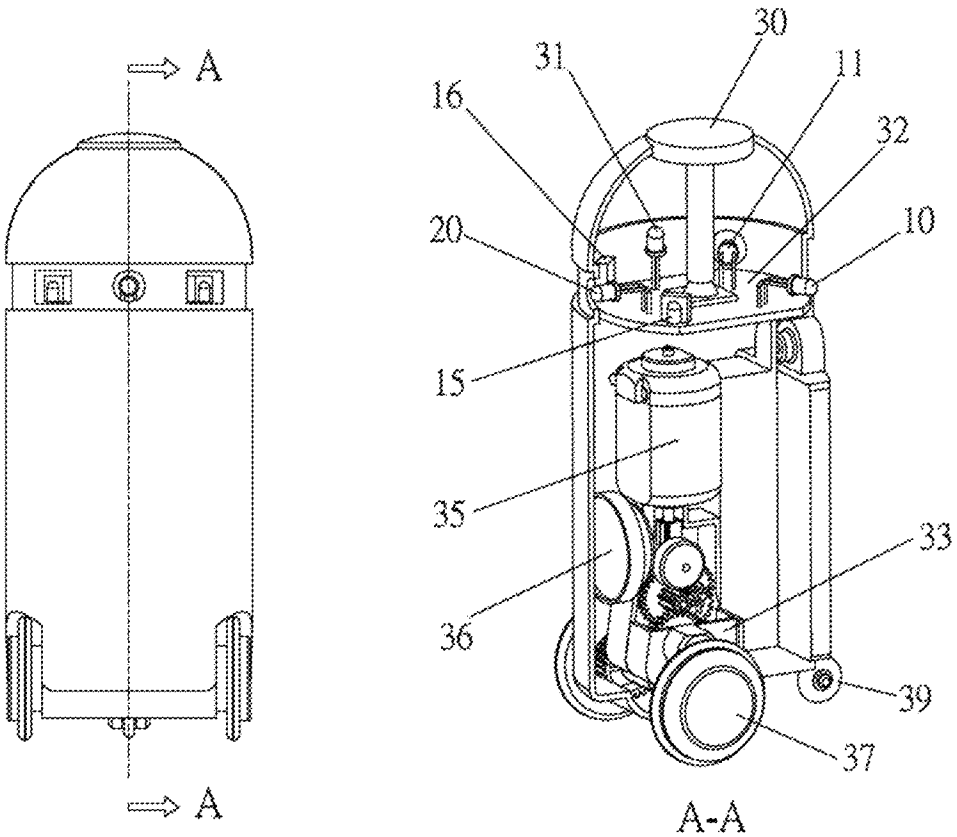
FIG.2-d

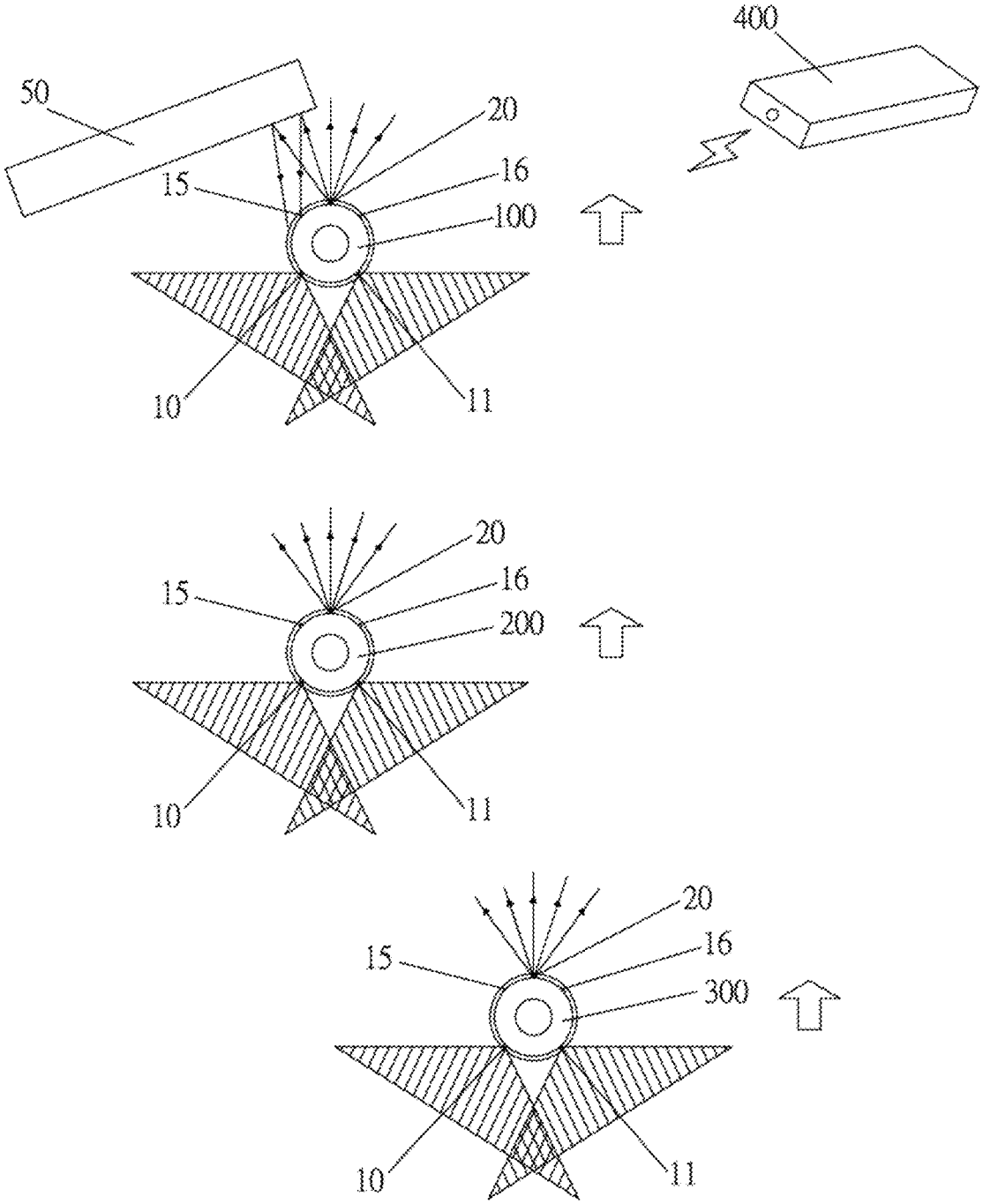
FIG.4-a

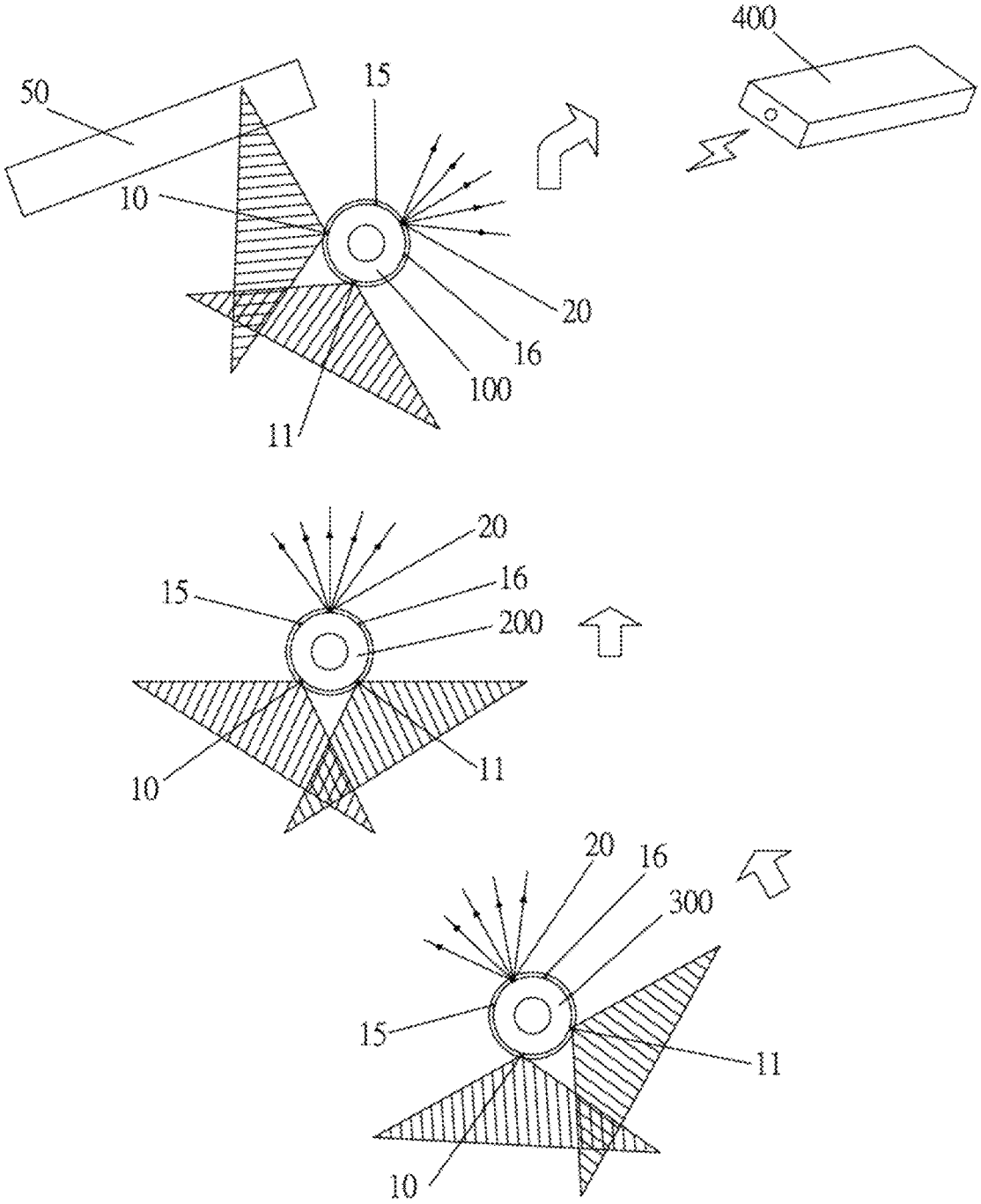
FIG.4-b

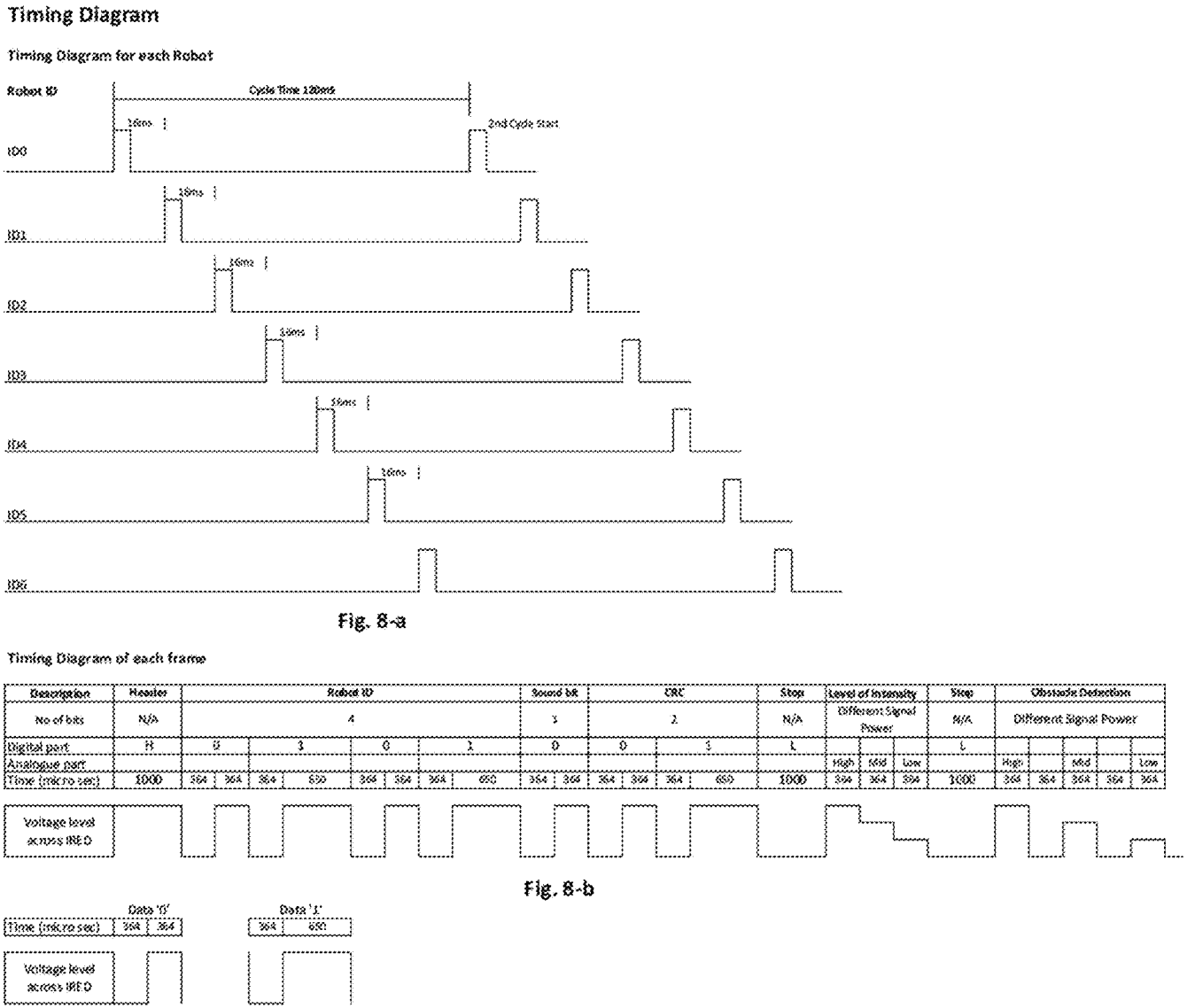
Timing Diagram
Timing Diagram for each Robot
Robot ID
Cycle Time 120ms
2nd Cycle Start
16ms
Fig. 8-a
Timing Diagram of each frame
Description
Header
Robot ID
Sound bit
CRC
Stop
Level of Intensity
Stop
Obstacle Detection
No of bits
N/A
4
1
2
N/A
Different Signal Power
N/A
Different Signal Power
Digital part
Analogue part
Time (sec to sec)
1000
364
364
650
364
364
364
364
364
364
364
364
650
1000
364
364
364
1000
364
364
364
Voltage level across IRED
Data '0'
Time (sec to sec)
364
364
Data '1'
364
650
Voltage level across IRED
High
Mid
Low
Fig. 8-b
Fig. 8-c

FOLLOWING ROBOT

CROSS REFERENCE TO RELATED APPLICATION

This application claims priority to Chinese Patent Application Number 201910010541.5, filed Jan. 3, 2019, entitled "一種智能玩具隨從的方法及應用該方法的玩具機械人" which is translated as "A methodology of an intelligent following toy robot and application of the same", which is incorporated by reference in its entirety herein.

BACKGROUND

The present disclosure relates generally to at least one Follower robot follows the path of the Leader robot.

SUMMARY

In one form there is at least one Follower robot that follows the path of the Leader robot using infrared (IR) positioning method.

A Leader robot would travel an arbitrary path or it can be controlled by a wireless transmitter. A second robot can follow the Leader while a third robot can follow the second one and so on. In order to have good reaction time and performance, the robot chain can allow up to seven robots. With this control method, robots are able to avoid obstacle and they follow the leader one by one in short range without collision This control method is basically related to positioning i.e. relative distance and direction measurement with using infrared system. Although ultrasonic sensor can also be used for such measurement, the Time Of Flight (TOF) in ultrasonic pulse is comparatively long and lead to limit the total no of robots in the chain. Additionally, the component size is large and solution cost is too high for toys market application.

The novel features of this disclosure, as well as the disclosure itself, both as to its structure and its operation, will be best understood from the accompanying drawings, taken in conjunction with the accompanying description, in which similar reference characters refer to similar parts.

DRAWINGS

Figure 3:
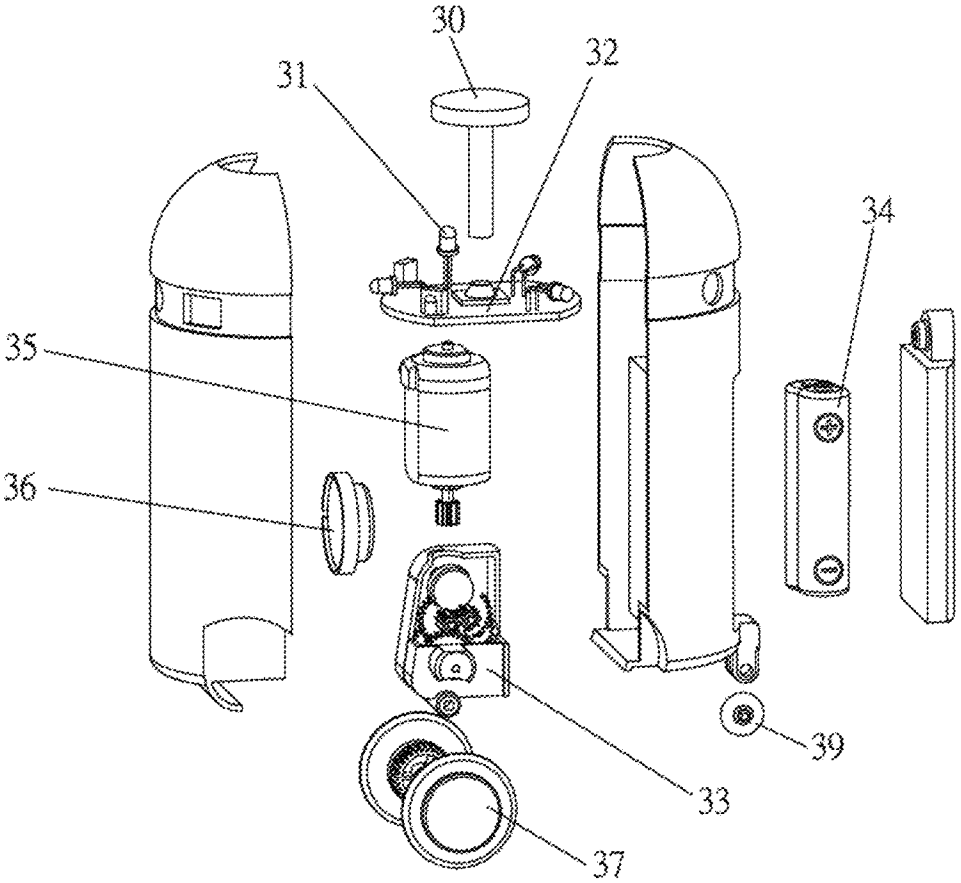
Figure 5:
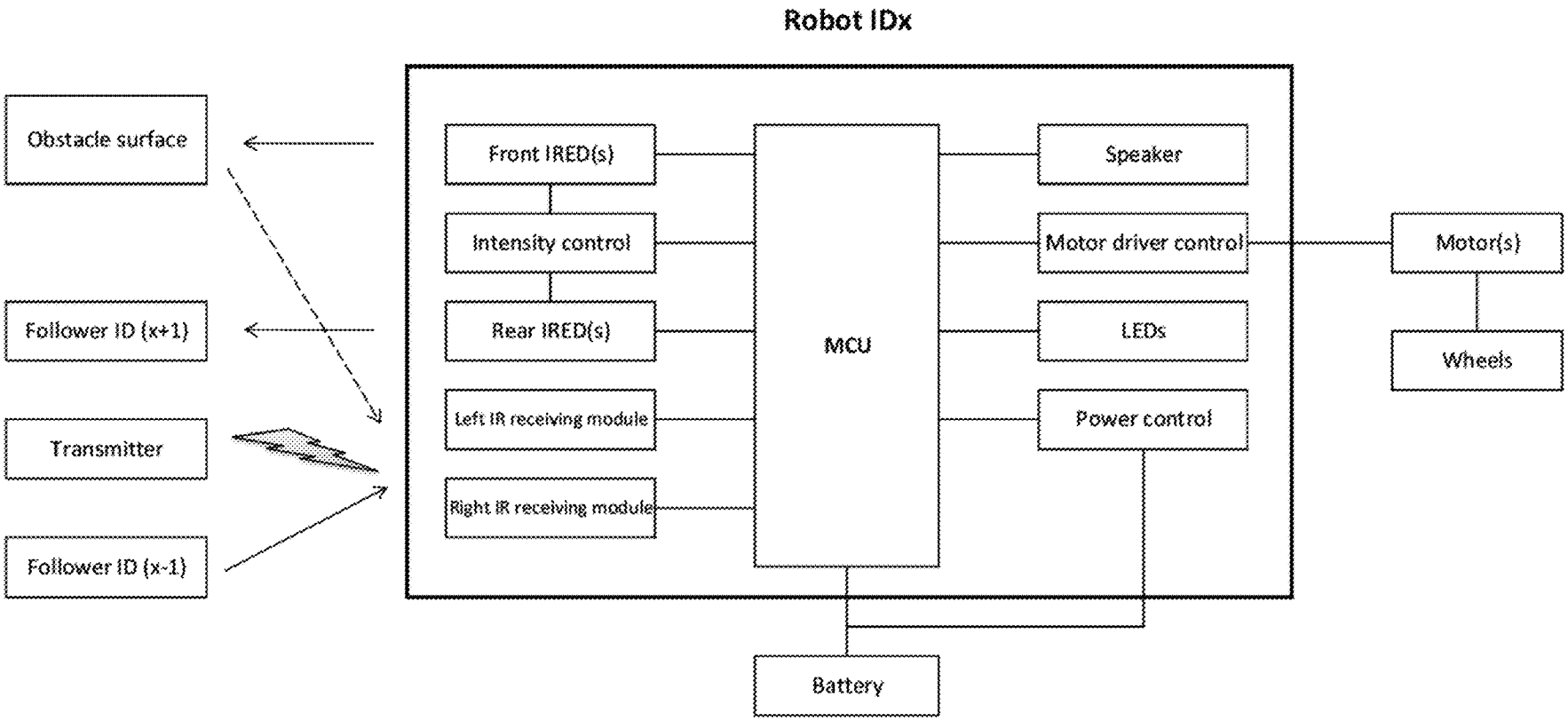
Figure 6:
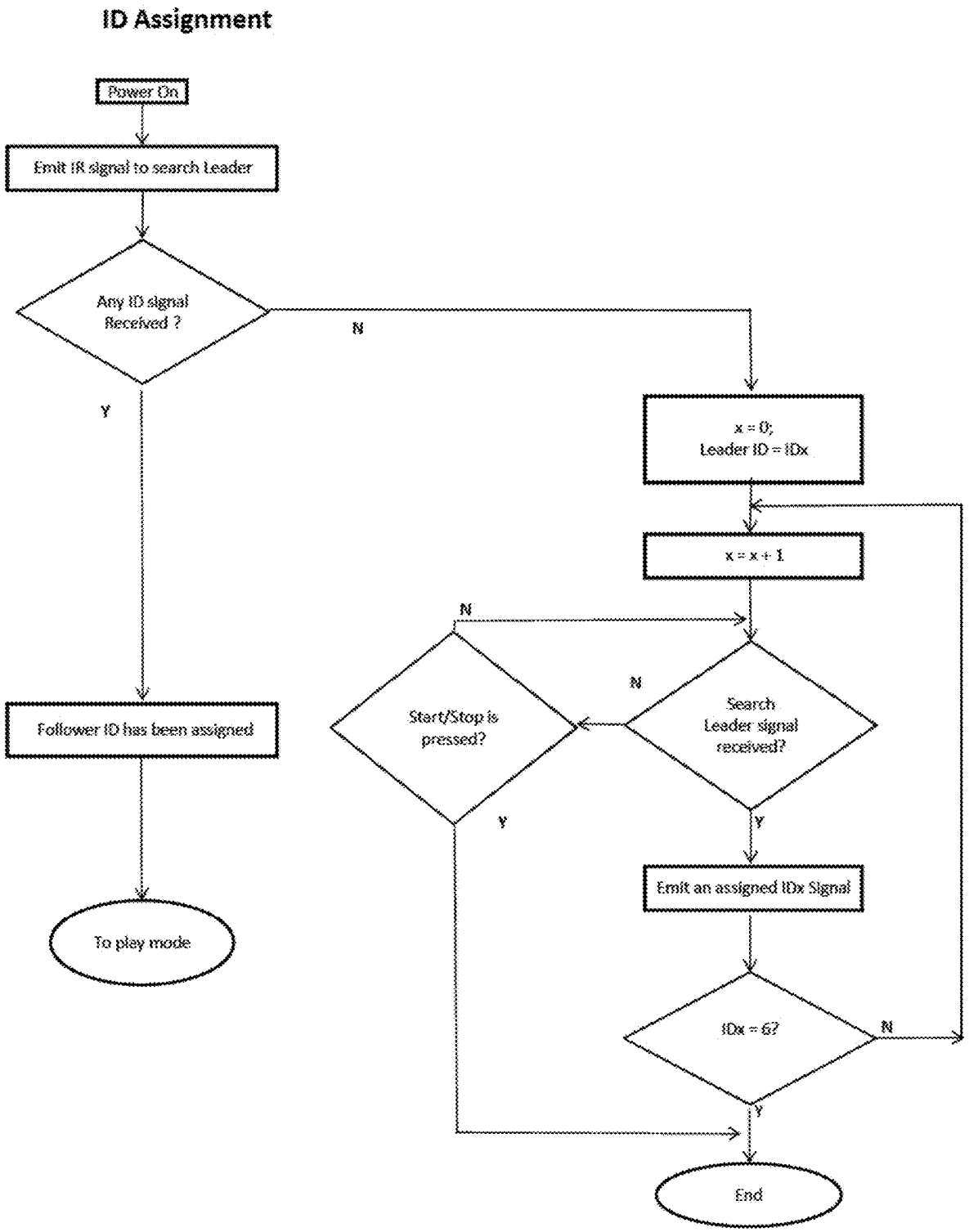
Figure 7:
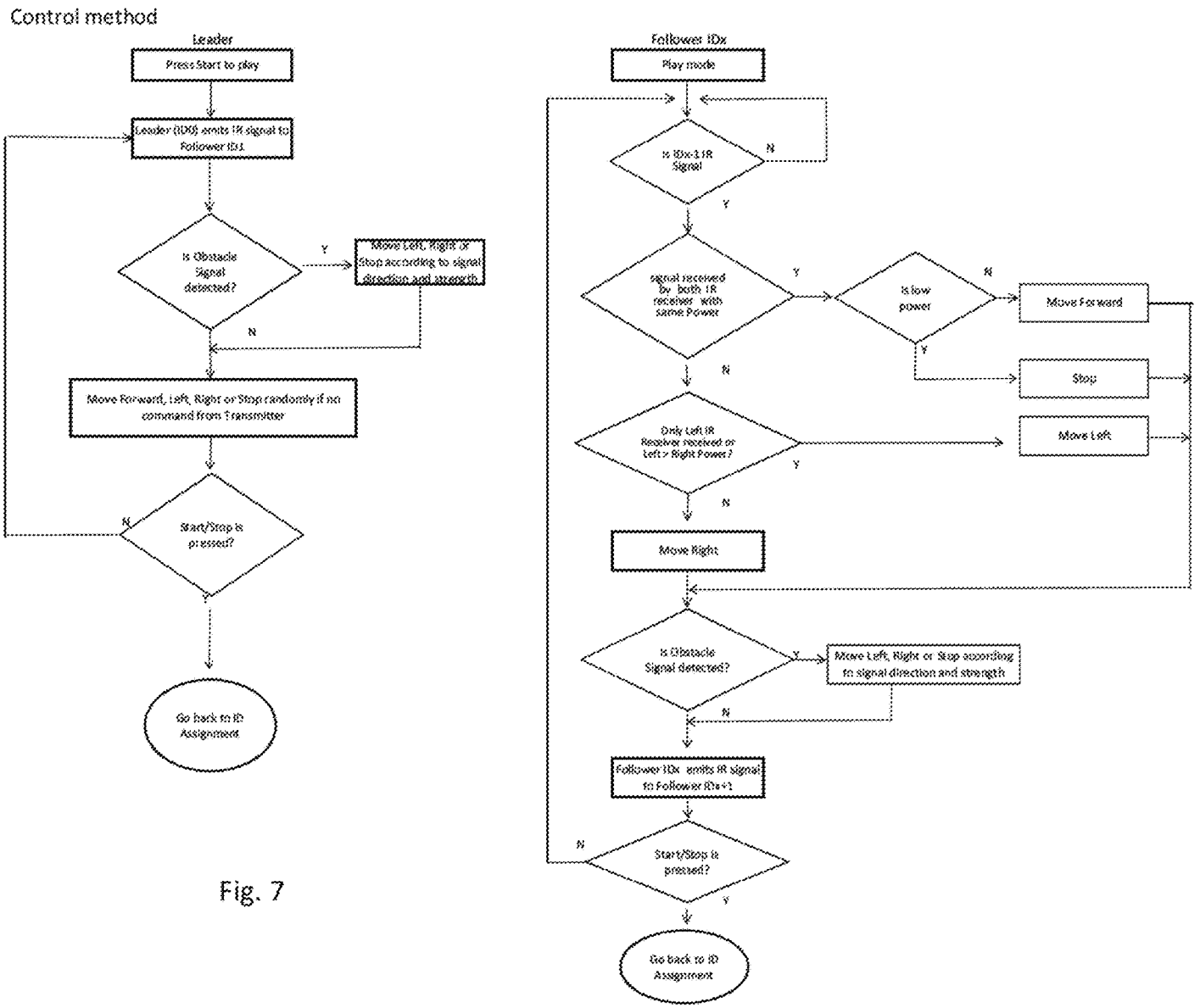

FIG. 1 is perspective view of robot.
FIG. 2-*a* is the front view of robot.
FIG. 2-*b* is the rear view of robot.
FIG. 2-*c* is the side view of robot.
FIG. 2-*d* is a cross-section view of robot at A-A.
FIG. 3 is an exploded view of robot.
FIG. 4-*a* shows one Leader and 2 Followers.
FIG. 4-*b* shows the new path of Leader and 2 Followers.
FIG. 5 is a block diagram of the electronic components.
FIG. 6 is a flow chart of ID assignment.
FIG. 7 is a flow chart of control method.
FIG. 8-*a* is a timing diagram of IR signal in each robot.
FIG. 8-*b* is a timing diagram of each frame.
FIG. 8-*c* is a timing diagram to represent signal '0' and '1'.

DESCRIPTION

A robot system comprises at least one follower robot and a leader robot. The follower robot is for following the path of the leader robot, and signals created between the follower and leader robots include, selectively, infrared (IR) signals. The signals permit the follower robot to follow the leader robot. A functionality is for the follower robot to follow the physical path and positioning of the leader robot.

A wireless transmitter is used so that the leader robot is permitted to travel selectively at least one of an arbitrary path or is controlled by the wireless transmitter. There can be a second robot for following the leader robot, the second robot being either directly controlled by the leader or indirectly controlled by following the first follower robot.

The robot system can include a series of follower robots for following the leader robot being either directly controlled by the leader or indirectly controlled by following another follower robot. There can be a robot chain of the leader robot and follower robots, selectively seven robots.

The robot system between relative robots for the positioning, selectively at least one of the relative distance measurement or direction measurement, can use an infrared system between respective robots.

A robot system comprising at least one follower robot and a leader robot, the follower robot being for following the path of the leader robot, signals between the follower and leader robots relating to positioning, selectively at least one of the relative distance measurement or direction measurement with an ultrasonic sensor for measurement of distance and direction, the signals being for facilitating a control of following action between respective robots.

A toy robot system comprising a first toy robot body being a follower robot, circuitry in the first robot body, a second toy body being a leader robot, circuitry in the second robot body, the follower robot being for following the path of the leader robot, signals between the circuitries of the leader robot and follower robot including, selectively, infrared (IR) signals, the signals being for controlling following action between respective robots.

In another form a robot system comprises at least one follower robot and a leader robot. The follower robot is for following the path of the leader robot. Signals between the follower and leader robots relating to positioning, selectively at least one of the relative distance measurement or direction measurement is with an ultrasonic sensor for measurement of distance and direction. The signals facilitating a control of following action between respective robots.

There is a toy robot having at least one motor 35 for wheel driving, a Start/Stop button 30, LEDs 31, PCBA 32, gear box 33, batteries 34, speaker 36, plurality of infrared emitting diodes (IRED) and at least 2 IR receiving modules. These modules can receive the modulated IR signal from other robots, transmitter 400 or signal from the robot itself for data manipulation by MCU. In my previous disclosure, U.S. Pat. No. 8,639,400, it is known that the intensity or brightness of light as a function of the distance from the light source follows an inverse square relationship. Thus, the relationship between light intensity and distance can be obtained and the distance between robots can be estimated.

In principle, the configurations of all robots are preferably the same. After ID assignment process, one robot becomes Leader while the remaining robots become Followers. The IRED 10 and 11 of a robot in FIG. 2-*a* to FIG. 2-*d*, each having a viewing angle of 110°, are put at the rear part of the robot so that the infrared ray coverage angle becomes double, i.e. 220°. On the other hand, a diverging lens can also be put in front of an IRED for spreading the IR ray. In this case, only one IRED is also acceptable. The IR data communication is unidirectional. IR signal from IRED 10 and 11 are synchronized, the modulated signal consists of both digital and analogue information in which the carrier frequency is within 30 to 40 kHz. The digital signal includes Header, Robot ID, Sound bit and CRC while the analogue part includes level of intensity. Within the coverage region, a Follower robot behind this robot should receive all digital information of IR signal. Whether it can receive analogue information depends on their separation distance. If it is short range, says 10 cm, it can receive more IR analogue signal. Conversely, if it is long range, says 100 cm, it can receive less or even no signal. Thus, the distance between robots can be roughly calculated.

There are 2 IR receiving modules 15 and 16 at the front end. The left receiving module 15 can receive IR signal mostly from its left region while the right receiving module 16 can receive IR signal mostly from its right region. When a robot with IDx emits a signal from IRED 10, 11, another robot next to it with ID(x+1) receives and decodes the IR signal correctly at left receiving module 15, the robot ID(x+1) turns left so that it points to robot IDx in front of it. Similarly, if robot ID(x+1) receives and decodes the IR signal correctly at right receiving module 16, the robot ID(x+1) turns right so that it points to robot IDx again. If signal is received at both left and right receiving module 15 and 16 simultaneously, the robot can either move forward at different speeds or even stop according to the duration of analogue part of IR signal received.

A least one IRED 20 is located at the front. This IRED emits an obstacle detection IR signal periodically in which it follows the time frame of IR data to avoid signal jam. If there is a signal reflection by obstacle's surface so that only left receiving module 15 receives this signal, the robot will make a right turn automatically. Similarly, it will make a left turn once IR signal is received by right receiving module 16. In FIG. 4*a* shows a scenario of one Leader and 2 Followers. The Leader moves towards a wall 50 while Follower ID1 doesn't face to Leader and Follower ID2 doesn't face to Follower ID1. In FIG. 4*b*, all robots will adjust their paths after having IR signal manipulation.

In time domain, it is not feasible to have more than one robot emitting IR signal at the same period of time. Otherwise, it will cause signal interference and affect the reaction time of each robot. Thus an ID assignment process is developed and the algorithm is as follows:

1. Power on first robot
2. It emits IR finding signal to search Leader.
3. If no response, it will define itself as Leader, its ID is 0
4. Power on second robot
5. It emits IR finding signal to search Leader.
6. Leader will have response by assigning and sending a Follower ID to this robot upon receipt the finding signal.
7. Then this is the $1^{st}$ Follower with ID1
8. Similarly, power on third robot
9. It emits IR finding signal to search Leader.
10. Leader will have response by assigning and sending a Follower ID to this robot upon receipt the finding signal.
11. Then this is the $2^{nd}$ Follower with ID2
12. Repeat this process until pressing Start button or all 6 Follower IDs have been assignment by Leader After ID assignment process, all robots can be put in queue and the Leader will be the first in this queue. The control algorithm is as follows:—

1. Leader ID0 sends IR communication signal to Follower ID1
2. Leader sends IR obstacle detection signal
3. Leader will turn left, right, move forward or stop according to the IR signal received in step 2 and signal from transmitter.
4. x=1
5. Wait for synchronize bit and a short delay
6. Follower IDx sends IR signal to Follower ID(x+1)
7. Follower IDx sends IR obstacle detection signal
8. Follower IDx will turn left, right, move forward or stop according to the IR signal received in step 6 and Robot ID(x−1)
9. x=x+1
10. Repeat step 5 to 9 until x=7
11. Repeat step 1 to 10 until pressing Start/Stop button In current IR data format, sound bit can determine which robot starts to play sound effect. As a result, singing a song or having dialogue between each robot can be implemented in this robot chain.

The numbering system in relation to the drawings is as follows.

| No | Description |
|---|---|
| 100 | Leader robot |
| 10 | Left rear IRED |
| 11 | Right rear IRED |
| 15 | Left receiving module |
| 16 | Right receiving module |
| 20 | Front IRED |
| 30 | Start/Stop button |
| 31 | LED |
| 32 | PCBA |
| 33 | Gear box |
| 34 | Batteries |
| 35 | Motor |
| 36 | Speaker |
| 37 | Driving wheels |
| 39 | Additional wheel |
| 500 | Wall or obstacle |
| 200 | Follower ID1 |
| 300 | Follower ID2 |
| 400 | Transmitter |

Some Other Implementations

The control method of transmitter is not limited to Infrared, it can be radio frequency such as 27 MHz, 40 MHz, 49 MHz or 2.4 GHz, or Bluetooth or WiFi.

Alternatively, it is allowed for the Leader to follow player's hand or follow a moving object. This can be easily achieved by changing the method of obstacle detection. The Leader moves towards obstacle rather than avoids obstacle.

Alternative, it is also allowed to play the robot without transmitter. In the situation, the Leader can perform autonomous driving as it equips with obstacle detection function.

The longer the period of IR communication, the poor the reaction time of robot. In current disclosure, the time frame of individual robot is around 16 ms. For 7 robots, the cycle time is 120 ms in which reasonable reaction time can be achieved.

The above description sets out features of the present disclosure. There are additional features that will form the subject matter of claims. It is to be understood that the disclosure is not limited in its application to the details of the construction and to the arrangement of the components set out in the description or as illustrated in the drawings. The disclosure is capable of other embodiments and of being practiced and carried out in various ways. Also, it is to be understood that the phraseology and terminology used is for the purpose of description and should not be regarded as limiting.

It will be appreciated by those skilled in the art that changes could be made to the embodiments described above without departing from the broad inventive concept thereof.

It is understood, therefore, that this disclosure is not limited to the embodiments disclosed, but it is intended to cover modifications within the spirit and scope of the present disclosure.

The invention claimed is:

1. A robot system comprising at least one follower robot of a plurality of follower robots and a leader robot, the plurality of follower robots being for following a path of the leader robot, signals being created between the follower and leader robots including, selectively, infrared (IR) signals, the signals being for permitting each follower robot to follow the leader robot, wherein upon power up of the at least one follower robot the at least one follower robot emits a search signal for a leader, and upon finding no leader identifies itself as the leader robot, and each remaining follower robot of the plurality of follower robots is selectively assigned a unique follower ID by the leader robot upon power up of each of the remaining follower robots.

2. The robot system of claim 1 comprising a functionality that the at least one follower robot follows the path and positioning of the leader robot.

3. The robot system of claim 1 including a wireless transmitter, and wherein the leader robot is permitted to travel selectively at least one of an arbitrary path or is controlled by the wireless transmitter.

4. The robot system of claim 1 including a second follower robot for following the leader robot, the second follower robot being either directly controlled by the leader or indirectly controlled by following the at least one follower robot.

5. The robot system of claim 1 including a series of follower robots for following the leader robot being either directly controlled by the leader or indirectly controlled by following another follower robot.

6. The robot system of claim 5 wherein there is a robot chain of the leader robot and follower robots, selectively seven robots.

7. The robot system of claim 1 relating between relative robots positioning, selectively at least one of a relative distance measurement or direction measurement, the relating being with an infrared system between respective robots.

8. A robot system comprising at least one follower robot of a plurality of follower robots and a leader robot, the at least one follower robot being for following a path of the leader robot, signals between the follower and leader robots relating to positioning, selectively at least one of relative distance measurement or direction measurement with an ultrasonic sensor for measurement of distance and direction, the signals being for facilitating a control of following action between respective robots, wherein upon power up of the at least one follower robot the at least one follower robot emits a search signal for a leader, and upon finding no leader identifies itself as the leader robot, and each of the plurality of follower robots is selectively assigned a unique follower ID by the leader robot upon power up of each the plurality of follower robots.

9. A toy robot system comprising plurality of follower robots, wherein each, follower robot being for following a path of a leader robot, wherein upon power up of a first of the follower robots, the first follower robot emits a search signal for a leader, and upon finding no leader identifies itself as the leader robot, and each of the plurality of follower robots is selectively assigned a unique follower ID by the leader robot upon power up of each of the follower robots.

10. The robot system of claim 9 comprising a functionality whereby each follower robot follows the physical path and positioning of the leader robot.

11. The robot system of claim 9 wherein the leader robot selectively travels at least one of an arbitrary path or is controlled by a wireless transmitter.

12. The robot system of claim 9 including a second robot for following the leader robot either directly or indirectly by following the first follower robot.

13. The robot system of claim 9 including a series of follower robots for following the leader robot either directly or indirectly by following another follower robot.

14. The robot system of claim 9 relating to positioning, selectively determining a relative distance and direction measurement with using infrared system.

15. The robot system of claim 9 relating to positioning, selectively at least one of the relative distance measurement or direction measurement with an ultrasonic sensor for measurement of distance and direction.

* * * * *